US009822931B2

(12) United States Patent
Harper et al.

(10) Patent No.: US 9,822,931 B2
(45) Date of Patent: Nov. 21, 2017

(54) METHOD AND APPARATUS FOR SERVICING A TANK, A PLUG, OR A TANK AND PLUG

(71) Applicant: Westport Power Inc., Vancouver (CA)

(72) Inventors: Gregory C. Harper, Delta (CA); Jason G. Newton, Vancouver (CA)

(73) Assignee: WESTPORT POWER INC., Vancouver (CA)

( * ) Notice: Subject to any disclaimer, the term of this patent is extended or adjusted under 35 U.S.C. 154(b) by 0 days.

(21) Appl. No.: 14/738,834

(22) Filed: Jun. 13, 2015

(65) Prior Publication Data

US 2016/0018060 A1 Jan. 21, 2016

Related U.S. Application Data

(63) Continuation of application No. PCT/CA2013/050909, filed on Nov. 27, 2013.

(30) Foreign Application Priority Data

Dec. 17, 2012 (CA) ..... 2798864

(51) Int. Cl.
*F17C 13/06* (2006.01)
*F17C 13/00* (2006.01)
(Continued)

(52) U.S. Cl.
CPC ..... *F17C 13/06* (2013.01); *F17C 13/002* (2013.01); *F17C 13/04* (2013.01); *B65D 90/00* (2013.01);
(Continued)

(58) Field of Classification Search
CPC ..... F17C 13/06; F17C 13/002; F17C 13/04; Y10T 137/6109
See application file for complete search history.

(56) References Cited

U.S. PATENT DOCUMENTS 3,327,491 A 6/1967 Andonian
4,194,523 A 3/1980 Lubieniecki
(Continued)

FOREIGN PATENT DOCUMENTS

FR 2290628 A1 6/1976

OTHER PUBLICATIONS

FR2290628MT-NPL.pdf; Espacenet Machine translation of FR 2290628 A1; Fines,Guy; Jun. 4, 1976.*
(Continued)

*Primary Examiner* — Craig Schneider
*Assistant Examiner* — Kevin Barss
(74) *Attorney, Agent, or Firm* — Carie C. Mager; C. Larry Kyle

(57) ABSTRACT

An apparatus for servicing a tank and/or a plug includes a valve having a first port sealingly couplable onto a tank port surrounding the plug, a second port, and a valve member operable between an open position providing a pathway between the first and second ports, and a closed position providing a sealed barrier between the first and second ports. The apparatus further includes an adapter sealingly couplable to the second port, and a plug displacement tool couplable to the adapter for displacing the plug relative to the tank when the first port is coupled to the tank port, the adapter is coupled to the second port, and the valve member is in the open position.

19 Claims, 5 Drawing Sheets

(51) Int. Cl.
*F17C 13/04* (2006.01)
*B65D 90/00* (2006.01)

(52) U.S. Cl.
CPC ..... *F17C 2227/0135* (2013.01); *F17C 2227/0157* (2013.01); *F17C 2227/048* (2013.01); *F17C 2250/036* (2013.01); *F17C 2250/038* (2013.01); *F17C 2260/015* (2013.01); *Y10T 137/6109* (2015.04)

(56) References Cited

U.S. PATENT DOCUMENTS 4,827,984 A * 5/1989 Young ..... F16L 55/134 137/15.15
5,261,150 A * 11/1993 Grube ..... B23Q 9/0014 248/226.11
5,592,965 A * 1/1997 Rakieski ..... F16K 43/00 137/315.41
5,801,825 A * 9/1998 Nutter ..... G02B 23/2492 356/241.1
6,087,581 A 7/2000 Emmer et al.
6,338,359 B1 1/2002 Welker
7,350,536 B2 * 4/2008 Evans ..... G01N 1/24 137/15.22
7,481,238 B2 * 1/2009 Ramoth ..... F16K 24/048 137/202
2003/0089118 A1 5/2003 Kunimoto et al.

OTHER PUBLICATIONS

International Search Report of the International Searching Authority dated Feb. 10, 2014, in connection with International Application No. PCT/CA2013/050909.
International Preliminary Report on Patentability dated Jun. 23, 2015, in connection with International Application No. PCT/CA2013/050909.
Canadian Office Action dated Mar. 25, 2013, in connection with the priority Canadian Patent Application No. 2,798,864.
Search Report issued by EPO dated Jun. 15, 2016 in connection with co-pending Europe Application No. 13865724.2.

* cited by examiner

METHOD AND APPARATUS FOR SERVICING A TANK, A PLUG, OR A TANK AND PLUG

CROSS-REFERENCE TO RELATED APPLICATIONS

This application is a continuation of International Application No. PCT/CA2013/050909 having a filing date of Nov. 27, 2013, entitled "Method and Apparatus for Servicing a Tank, a Plug, or a Tank and Plug", which claimed priority benefits from Canadian patent application No. 2,798,864 filed on Dec. 17, 2012. The PCT/CA2013/050909 international application is hereby incorporated by reference in its entirety.

FIELD OF THE INVENTION

The present disclosure is directed, at least in part, towards a method and apparatus for servicing a tank, a plug that seals the tank, or both the tank and the plug. In some embodiment the tank and/or plug are serviced while preserving a pressure within the tank.

BACKGROUND OF THE INVENTION

Tanks are sealed enclosures used to store fuel and other fluids prior to being withdrawn for use in industrial processes. One example is a gas tank for an internal-combustion engine, where gasoline is stored before being drawn into a fuel system and vaporized into ignitable fuel for combustion by the engine. In the case of cryogenic fuels, double-walled tanks are often used, comprising an inner enclosure for holding liquefied fuel, and an outer enclosure surrounding the inner enclosure to form an insulation space. The insulation space can be kept at a vacuum level to prevent, or at least reduce, heat transfer with the fuel, which in turn prevents, or at least reduces vaporization to keep the fuel in a liquefied state. For some applications the tank and/or insulation space can be maintained under a positive pressure. A vacuum rated plug can be used to seal the tank contents or maintain the insulation space at the vacuum level. The plug can also be rated for maintaining a positive pressure. Over time however, the plug can require servicing due to scratches, indentations and/or wear and tear on its seals. Servicing the plug can require removing it from the tank. Current methods for removing a vacuum rated plug, involve pressurizing the tank with nitrogen gas, and pulling the plug in atmosphere, which exposes the tank and its contents to external contaminants and compromises the vacuum level in the tank. Analogous methods can be used to service a positive pressure rated plug in that the pressure within the tank can be brought to atmosphere prior to the plug being pulled, which exposes the tank and its contents to external contaminants.

SUMMARY OF THE INVENTION

A method and apparatus for servicing a tank and/or a plug that seals the tank are described herein. Also described, is a method and apparatus for servicing a tank and/or a plug that seals the tank while preserving a pressure within the tank.

An apparatus for servicing a tank and/or a plug that seals the tank comprises: a valve assembly comprising a first port sealingly couplable onto a tank port surrounding the plug, a second port, and a valve member operable between an open position providing a pathway between the first and second ports, and a closed position providing a sealed barrier between the first and second ports; an adapter sealingly couplable to the second port; and a plug displacement tool couplable to the adapter for displacing the plug relative to the tank when the first port is coupled to the tank port, the adapter is coupled to the second port, and the valve member is in the open position. The adapter can further comprise an outlet port for removing or supplying air or a pressurized fluid.

The plug displacement tool of the apparatus described above can further comprise an attachment mechanism at a contact end for engagably coupling the plug to the contact end. The plug displacement tool can further comprise a handle at an opposite end to the contact end, and can comprise a substantially elongated rod of sufficient length for engagably coupling with the plug.

The valve assembly of the apparatus described above can be selected from the group of a ball valve, a gate valve, and a butterfly valve.

A method for removing a plug sealing a tank while also preserving a pressure within the tank, comprises: (i) sealingly coupling a first port of a valve assembly onto a tank port surrounding the plug, and sealingly coupling an adapter to a second port of the valve assembly, the adapter, the valve assembly, and the plug defining an interior cavity; (ii) pressurizing the interior cavity to sufficiently maintain a standing pressure within the interior cavity using an outlet port connected to, and in fluid communication with, the adapter; (iii) displacing the plug from the tank beyond a valve member of the valve assembly; (iv) actuating the valve member to a closed position to provide a sealed barrier between the first and second ports; and (v) decoupling the adapter from the second port to remove the plug.

A method for servicing a tank while also preserving a pressure within the tank comprises: (i) sealingly coupling a first port of a valve assembly onto a tank port surrounding a plug, and sealingly coupling an adapter to a second port of the valve assembly, the adapter, valve assembly, and the plug defining an interior cavity; (ii) pressurizing the interior cavity to sufficiently maintain a standing pressure within the interior cavity using an outlet port connected to, and in fluid communication with, the adapter; (iii) displacing the plug from the tank beyond a valve member of the valve assembly; (iv) actuating the valve member of the valve to a closed position to provide a sealed barrier between the first and second ports; (v) removing the plug from the adapter; (vi) introducing a servicing tool into the adapter, and sealing coupling the adapter to the second port of the valve assembly to define a secondary cavity between the valve member in closed position, the second port, and adapter; (vii) pressurizing the secondary cavity using the outlet port, and opening the valve member to provide access for the servicing tool to service the tank.

The tank can comprise a singled walled tank, a doubled wall tank, an insulation space outside of the tank or other multi-walled tank. If the pressure within the tank (either a single, double, or multi-walled tank) in methods described above is a vacuum, then the step of pressurizing the interior cavity comprises removing fluid, such as air, from the interior cavity sufficient to maintain a standing vacuum within the interior cavity. Alternatively, the pressure within the tank (either a single, doubled, or multi-walled tank) can be a positive pressure, then the step of pressurizing the interior cavity comprises adding fluid, such as air, into the interior cavity sufficient to maintain the pressure within the interior cavity.

In the methods described above, the step of displacing can be performed with a plug displacement tool. The plug displacement tool can be a substantially elongated rod with an attachment mechanism, and the methods can further comprise a step of engagably coupling the plug to the elongated rod prior to the step of displacing the plug from the tank. The valve can be a two port valve, and selected from the group of a ball valve, a gate valve, or a butterfly valve.

The method for removing a plug can further comprises a step of decoupling the plug from the plug displacement tool prior to a step of decoupling the adapter.

The methods described above can further comprise a step of servicing the plug through inspection, cleaning, conditioning, patching, bonding, replacing seals, or replacing the plug.

In the method for servicing a tank, the tank servicing tool can be selected from the group of a cleaning tool, a stereoscope, a camera, a radiation emitting device, and a sampling device.

The method for removing a plug can further comprise installing the plug by: (vi) introducing the plug into the adapter, and sealingly coupling the adapter to the second port of the valve assembly, to define a secondary cavity between the valve member in closed position, the second port, and adapter (vii) pressurizing the secondary cavity using the outlet port and actuating the valve member of the valve assembly to an open position to provide a pathway between the first and second ports; and (viii) installing the plug into the tank port.

The method for removing a plug can further comprise can further comprise ix) removing the valve assembly from the tank port.

The method for servicing a tank can further comprise installing the plug by: (ix) withdrawing the servicing tool from the tank and past the valve assembly; (x) actuating the valve member of the valve to a closed position to provide a sealed barrier between the first and second ports; (xi) removing the servicing tool from the adapter and introducing the plug into the adapter to define a secondary cavity between the valve member in closed position, the second port, and adapter; (xii) pressurizing the secondary cavity using the outlet port and actuating the valve member of the valve assembly to an open position to provide a pathway between the first and second ports; and (xiii) installing the plug into the tank port.

The method for servicing a tank can further comprise (xiv) removing the valve assembly from the tank port.

A method of removing a plug installed in a port of a vessel, wherein the plug is employed to preserve a pressure of an interior space on one side of the plug comprises: (i) creating an enclosing space on a second side of the plug opposite the one side of the plug, such that a pressure of the enclosing space equals the pressure of the interior space within a predetermined range; (ii) removing the plug from the port away from the interior space whereby the pressure of the interior space remains within said predetermined range; (iii) isolating a portion of the enclosing space containing the plug from the interior space; and (iv) exposing the plug to atmosphere; wherein the pressure of the interior space remains within the predetermined range.

As described herein, the present disclosure provides an apparatus and method for removing a plug from a tank, servicing the tank, or a combination thereof, while at the same time maintaining the pressure present within the tank. The tank can be a single walled tank, a double walled tank, or a multi-walled tank, the volume comprising the pressure can be an insulation space surrounding the tank. By maintaining pressure within the tank prior to plug removal and during servicing, adverse effects associated with altering the pressure of the tank are reduced. Such adverse effects associated with altered pressure can include vaporization of fuel that is in a liquefied state, exposing the tank and its contents to external contaminants, and compromising the vacuum level in the tank.

DETAILED DESCRIPTION OF ILLUSTRATIVE EMBODIMENT(S)

An apparatus and method for servicing a tank, a plug that seals the tank, or both the tank and the plug while at the same time preserving a pressure within the tank, are described herein.

The pressure can be a positive pressure (for example, above atmospheric pressure), or a negative pressure (for example, a vacuum pressure below atmosphere), that is maintained in the tank, the insulation space, for example of a double-walled tank, or both the tank and the insulation space. The apparatus can be used on conventional fuel tanks and double-walled or multi-walled tanks. The apparatus can allow for removal and installation of the plug without exposing the tank contents, tank interior, and/or the insulation space to atmosphere. Following removal of the plug, the plug can be serviced through inspection, repair, replacement, or a combination thereof. The tank can also be serviced through inspecting, cleaning, or repairing the tank interior, or by sampling the tank contents, while the plug is removed. After servicing the plug and/or tank, the plug can be installed back onto the tank using the apparatus while still maintaining the original pressure in the tank. Accordingly, the apparatus and method precludes the need to expose the tank interior and/or insulation space to atmospheric conditions, which could contaminate its contents, or compromise the pressure level in the tank interior or insulation space.

Figure 1:
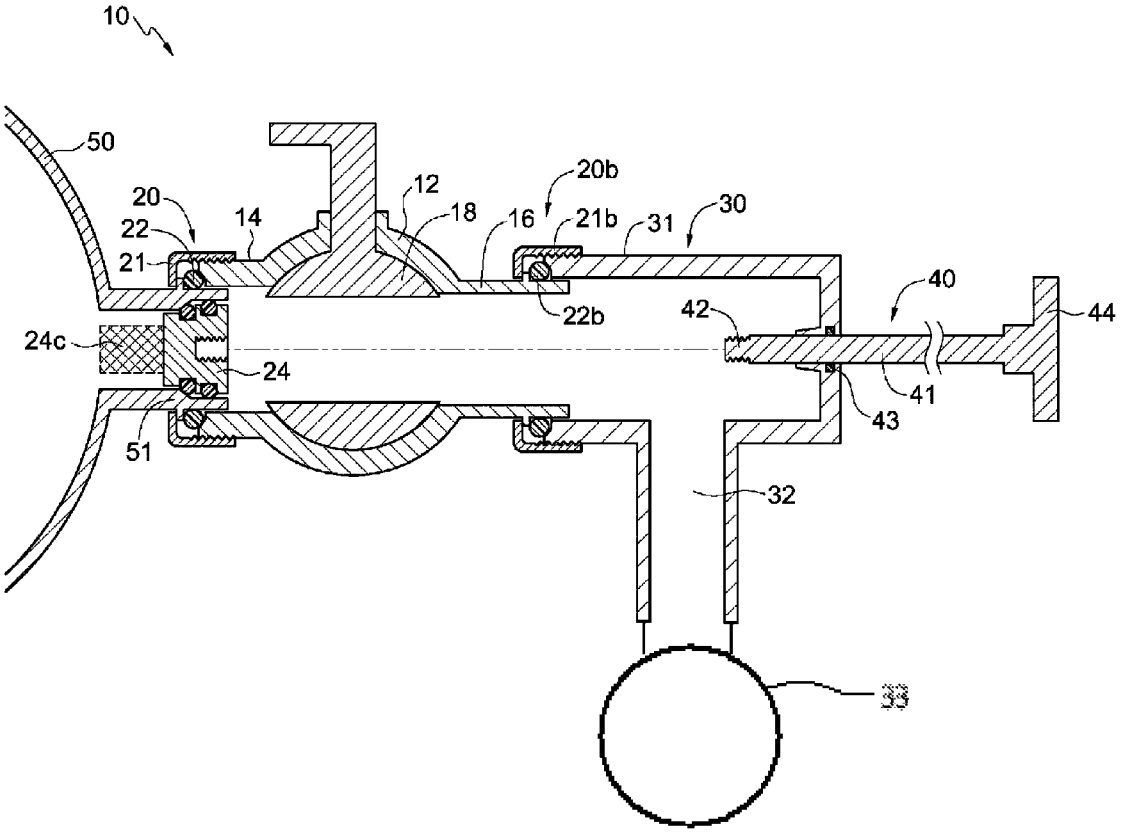
FIG. 1 is a cross-sectional side view of an apparatus for servicing a plug or a tank.

Referring to FIG. 1, apparatus 10 is shown for servicing tank 50 and plug 24 installed on tank 50 while also preserving a vacuum within tank 50. A similar apparatus can also be used to preserve a positive pressure within tank 50.

Apparatus 10 comprises valve or valve assembly 12 (for example, a vacuum valve), and a valve operator comprising adapter 30 (for example, a vacuum adapter), and plug displacement tool 40. Valve assembly 12, for example a vacuum valve, comprises first port 14, second port 16, and valve member 18. First port 14 is sealingly couplable to tank 50 through fitting 20 (for example a vacuum fitting). Valve member 18 is operable between an open position which permits a fluid pathway between first port 14 and second port 16, and a closed position that provides a sealed barrier between first port 14 and second port 16. Adapter 30, for example a vacuum adapter, comprises inlet 31 sealingly couplable to second port 16 of valve 12, and outlet 32. Plug displacement tool 40 comprises elongated rod 41 with attachment mechanism 42 at a contact end and handle 44 on an end opposite contact end. Any attachment mechanism can be used for example but not limited to, a ball and socket connection, a snap-fit connection, a hook and loop connection, a magnet, a threaded receptor, a clamp, a pressure clip or key removal tool, or a combination thereof. As shown in FIG. 1, elongated rod 41 extends through an aperture of adapter 30, and is slidingly and sealingly coupled to adapter 30 via seal 43. Seal 43 can be a suitable seal, for example an O-ring, gasket, grease, or other seal; in some embodiments a bellow arrangement between tool 40 and adapter 30 can be employed. The dimensions of elongated rod 41 can vary according to the size and shape of adapter 30 and valve assembly 12, but has a sufficient length for engagably coupling plug 24 when sliding through the aperture. When first port 14 of valve 12 is coupled to tank 50 to surround plug 24 and adapter 30 is coupled to second port 16, the longitudinal axis of elongated rod 41 is substantially axially aligned with the outer plane of plug 24 to displace plug 24. It is noteworthy that plug 24 is shown for a negative pressure application in FIG. 1, as well as in FIGS. 2 and 3, whereby pressure external to tank 50 secures plug 24 to tank port 51. When plug 24 is employed in a positive pressure application, plug 24 would be secured to tank port 51 by way of a mechanical securing apparatus (not shown) such that the positive pressure inside tank 50 does not force plug 24 out of tank port 51.

Plug Removal

Still referring to FIG. 1, the first step in servicing tank 50 or plug 24 involves removal of plug 24. To do this, first port 14 of valve 12 is sealingly coupled onto tank port 51 surrounding plug 24. Plug 24 comprises seals on its circumference for example an O-ring, a gasket, grease, or other seal. In some embodiments a bellow arrangement between tool 40 and adapter 30 is employed and is press-fit inside tank port 51 of tank 50 to form a sealed barrier across tank port 51 for maintaining a pressure in the insulation space of tank 50. Pressure fitting 20, such as a slip nut fitting comprising nut portion 21 with internal threads, and seal 22 such an O-ring or other seal as described above, are used to sealingly couple first port 14 to tank port 51. As nut portion 21 is screwed onto corresponding external threads of first port 14, it compresses seal 22, which radially expands to engage a groove (not shown) on the outer circumference of tank port 51 to couple tank 50 and first port 14 together and provide a sealing engagement sufficient for maintaining positive or negative pressures inside tank 50. Inlet 31 of adapter 30 is also sealingly coupled onto second port 16 of valve 12 with another pressure fitting 20*b* comprising nut portion 21*b* and seal 22*b*. As shown in FIG. 1, an interior cavity is defined between plug 24, valve 12, and adapter 30, which is a singular continuous cavity when valve member 18 is in the open position to provide a fluid pathway between first port 14 and second port 16.

If a vacuum is to be maintained, air is removed from adapter 30 via outlet 32 prior to valve 12 being opened. When valve 12 is opened air can be removed from the whole of the interior cavity via outlet 32 of adapter 30 to maintain a standing vacuum in the interior cavity. The standing vacuum can comprise a pressure equal to or lower than the vacuum in tank 50 (for example, the vacuum level in the insulation space) in order to at least preserve the original vacuum level in tank 50.

Once a standing vacuum is maintained in the interior cavity, plug 24 is displaced from tank 50 with plug displacement tool 40. As will be explained below, plug 24 is displaced beyond valve member 18 towards adapter 30. When valve member 18 is in the open position, as shown in FIG. 1, elongated rod 41 can slide through the interior cavity via sliding coupling with seal 43 to engagably couple plug 24 through attachment means 42. While attachment means 42 can comprise known means sufficient to engagably couple elongated rod 41 to plug 24, it is shown in FIG. 1 as a threaded coupling that screws into a corresponding threading on plug 24. Once coupled, plug 24 can be displaced by simply pulling handle 44 to pull plug 24 away from tank port 51 of tank 50.

Once plug 24 has been displaced beyond valve member 18, valve member 18 can be actuated to the closed position to provide a vacuum sealed barrier between first port 14 and second port 16. In this way, valve 12 acts to seal tank port 51 to maintain the vacuum within tank 50 in place of plug 24. As valve assembly 12 now directly seals tank port 51, plug 24 can be removed for servicing by decoupling adapter 30 from second port 16, and detaching, for example unscrewing, plug 24 from elongated rod 41. Servicing can comprise inspection of plug 24 for damage or wear, testing or replacement of seals, patching, bonding, or conditioning of the surface of plug 24, or replacement of plug 24.

By defining an interior cavity next to plug 24 prior to removal of plug 24, using valve 12 and adapter 30, and then removing air from the interior cavity to maintain a standing vacuum, an isolated vacuum chamber is formed outside plug 24 allowing it to be displaced without compromising the vacuum inside tank 50 or exposing the contents of tank 50 to external contamination. Accordingly, after displacing plug 24 beyond valve member 18, valve member 18 can be actuated to the closed position to directly seal tank port 51 and maintain the vacuum level inside tank 50. This procedure allows plug 24 to be removed for servicing without compromising the vacuum level of tank 50, including the insulation space within tank 50.

As noted above, in some embodiments tank 50 can define a space for holding a fluid at a positive pressure and apparatus 10 can also be used to service plug 24 when installed in such tanks, allowing for removal and installation of plug 24 without compromising the positive pressure level inside tank 50. In such embodiments, removal of plug 24 is performed analogously to that described above for tank 50 with a negative pressure environment, except instead of removing air from the interior cavity, or if required, in addition to removing air from the interior cavity, a pressurized fluid is added to form a standing pressure in the interior cavity. This can be accomplished by adding pressurized fluid through outlet 32 of adapter 30 with a compressor or pump, referred to with reference numeral 33. The pressurized fluid can comprise an inert gas, such as nitrogen or helium, or can comprise the same fluid stored in tank 50 or insulation space where for example a double walled tank is employed (not shown). When the standing pressure has been maintained in the interior cavity, plug 24 can be displaced and valve member 18 can be actuated to the closed position to directly seal tank port 51 and maintain the positive pressure level inside tank 50, including insulation space, or other multi-walled space within tank 50.

Tank and Plug Servicing

After removal of plug 24, it can be inspected or serviced. Plug servicing can comprise cleaning plug 24, conditioning or patching the surface of plug 24, replacing the seals and/or rings of plug 24, or combinations thereof. Plug 24 can also be replaced in the case of severe damage or wear.

Tank 50 interior, including insulation space, or other multi-walled space, can also be inspected or serviced while plug 24 has been removed with apparatus 10. To service tank 50, plug displacement tool 40 can be replaced with tank servicing tool (not shown) and coupled to adapter 30. Inlet 31 of adapter is then sealingly coupled to second port 16 of valve 12 with fitting 20*b*. This defines a secondary cavity between valve member 18 in closed position, second port 16, and adapter 30. The secondary cavity is then pressurized, or for negative pressure applications, air can be removed, via outlet 32 to maintain a secondary pressure inside the secondary cavity. Once secondary pressure has been maintained in the secondary cavity, valve member 18 is actuated to the open position to provide a pathway between second port 16 and first port 14 to allow tank servicing tool to enter through tank port 51 to access tank 50 interior for inspection or servicing.

The secondary cavity provides a sealed and isolated environment, that when sufficiently pressurized, allows valve member 18 to actuate back to the open position without compromising the pressure inside tank 50 or exposing its contents to external contamination. When valve member 18 is actuated to the open position, tank servicing tool can be inserted through the open pathway created between first port 14 and second port 16 to inspect or service tank 50 interior. After the tank has been serviced, tank servicing tool can be withdrawn from tank 50, and valve member 18 can be actuated to the closed position to seal tank port 51 and preserve the pressure of tank 50. Accordingly, apparatus 10 allows servicing of tank 50 without compromising the pressure level maintained in tank 50, or exposing tank 50 contents to external contamination.

After servicing tank 50, the tank servicing tool can be replaced by plug displacement tool 40 for installing serviced plug 24 back into tank 50. In alternate embodiments adapter 30 is removed when valve 12 is closed and an assembly dedicated to the servicing tool is coupled to second port 16 with fitting 20*b*. The service tool assembly can have an outlet similar to outlet 32 to maintain the desired condition in the secondary cavity so that valve 12 can be opened to allow the service tool to enter tank 50.

Similar to when removing plug 24, tank servicing can be performed with apparatus 10 when tank 50 maintains either a positive or a negative pressure. For negative pressure applications, the step of pressurizing the secondary cavity comprises removing air from the secondary cavity, and the secondary pressure comprises a pressure equal or less than the pressure in tank 50. For positive pressure applications, the step of pressurizing the secondary cavity comprises injecting pressurized fluid into the secondary cavity, and the secondary pressure comprises a positive pressure equal to or greater than the pressure in tank 50.

Tank servicing tool can comprise plug displacement tool 40 or an extension device, with a servicing device coupled (not shown). Servicing device can comprise a device used for performing a specific servicing task. For example, the servicing device can comprise a cleaning tool for cleaning tank port 51, or the interior of tank 50, including the insulation space. Servicing device can also comprise a stereoscope or camera for inspecting the insulation space of tank 50. Servicing device can also comprise a tank treatment, for example but not limited to a treatment using a radiation emitting device, such as a UV source, for disinfecting tank 50 or energizing contaminants inside the tank 50 to be later absorbed by reactive material such as a getter. Servicing device can also comprise a sampling device used to sample tank 50 contents, including contaminants inside tank 50.

In certain embodiments, sampling can also be performed using apparatus 10 without a specific servicing device. For example, after removing plug 24, gasses in tank 50 will expand into the interior cavity. Plug 24 can be reinserted into tank port 51 to seal tank 50 and valve member 18 can be actuated to closed position to capture gasses from tank 50 in the secondary cavity between valve member 18 in closed position, second port 16, and adapter 30. First port 14 of valve 12 can then be uncoupled from tank port 51, and apparatus 10 can be brought to an analyzer to analyze trapped gases in the secondary cavity. Outlet 32 can be used to transfer gases from the secondary cavity to the analyzer, and can have a valve (not shown) attached for facilitating transfer.

Plug Installation

To re-install plug 24, and with reference to FIG. 1 where tank 50 is maintaining a vacuum environment, plug 24 is attached to, for example by being screwed onto the threading of, elongated rod 41. The plug displacement tool 40 is inserted within adapter 30 and inlet 31 of the adapter 30 is then aligned with second port 16 such that removed plug 24 is aligned between tank port 51 and adapter 30. Inlet 31 is then sealingly coupled to second port 16 with fitting 20*b*. A secondary cavity is now defined between valve member 18 in closed position, second port 16, and adapter 30. Air can be removed from secondary cavity via outlet 32 in order to maintain a secondary vacuum inside the secondary cavity. Similar to when removing plug 24, the secondary vacuum can also comprise a pressure equal to or lower than the vacuum inside tank 50 to at least preserve its original vacuum level. Once a secondary vacuum is maintained within the secondary cavity, valve member 18 is actuated to the open position to provide a pathway between second port 16 and first port 14, and expose plug 24 to tank port 51. Elongated rod 41 can slide through valve 12 to install plug 24 back into tank port 51 to seal tank 50 and maintain its vacuum. Elongated rod 41 can then be detached, for example unscrewed, from installed plug 24 by turning handle 44, and first port 14 can be uncoupled from tank port 51 to remove apparatus 10 from tank 50.

Similar to the interior cavity, the secondary cavity also provides a pressure sealed environment that allows valve member 18 to actuate back to the open position without compromising the vacuum within tank 50 or exposing its contents to external contamination. Actuating valve member 18 to the open position provides an open pathway between first port 14 and second port 16 to install serviced plug 24 back into tank port 51. Once installed into tank port 51, plug 24 directly seals tank 50 in place of valve 12. First port 14 can then be uncoupled from tank port 51 to remove apparatus 10 from tank 50. Accordingly, apparatus 10 allows plug 24 to be serviced without compromising the pressure level maintained in tank 50, or exposing tank 50 contents to external contamination. Sometimes plug seals can deteriorate or be otherwise compromised causing the pressure level in tank 50 to be higher than desired in the case of a negative pressure space (or lower than desired in the case of a positive pressure space). This is often the reason for requiring removal, inspection and servicing of plug 24. In such cases prior to re-installation of plug 24, apparatus 10 can be employed to restore pressure in tank 50 to the desired pressure.

The same method as just described can also be performed using a positive pressure in place of a vacuum.

Figure 2:
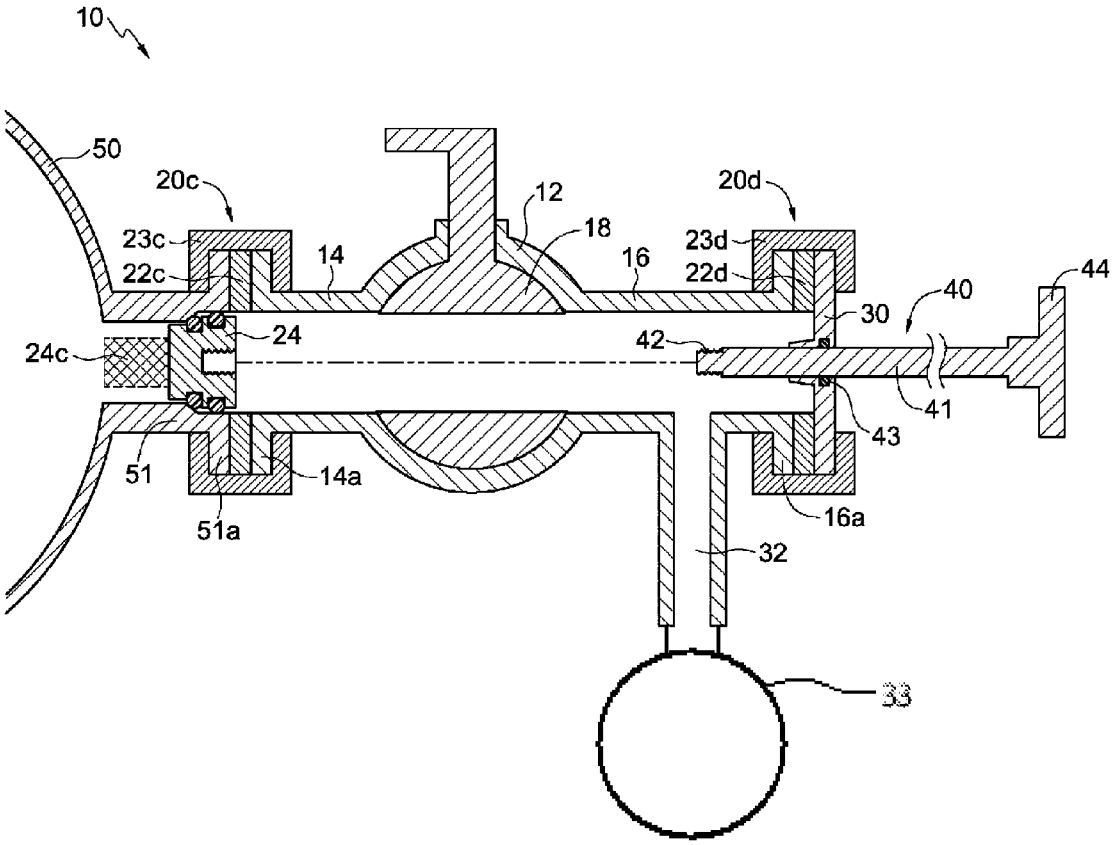
FIG. 2 is a cross-sectional side view of an apparatus for servicing a plug or a tank, according to another embodiment.

FIG. 2 shows another example of apparatus 10 similar to that of FIG. 1, and also operable to service plug 24 in tank 50 and maintain a negative or positive pressure environment. However, the embodiment in FIG. 2 differs in that fittings 20*c* and 20*d* comprise flange fittings, adapter 30 comprises a substantially planar plate, and outlet 32 has been relocated to second port 16 of valve 12. Flange fittings 20*c* and 20*d* comprise clamps 23*c* and 23*d*, and seals 22*c* and 22*d*. In some embodiments, seals 22*c* and 22*d* O-rings, diaphragms, or the like. As shown in FIG. 2, flange fittings are used to sealingly couple flange 14*a* of first port 14 to flange 51*a* of tank port 51, and adapter 30 to flange 16*a* of second port 16. Seal 22*c* is provided between tank flange 51*a* and flange 14*a* of first port 14, and seal 22*d* is provided between flange 16*a* of second port 16 and adapter 30. Clamp 23*c* is then positioned over flanges 51*a* and 14*a*, and tightened to compress seal 22*c* and lock flanges 51*a* and 14*a* together to provide a vacuum sealed coupling between tank 50 and first port 14. Similarly, clamp 23*d* is also positioned over flange 16*a* of second port, and adapter 30, and tightened to compress seal 22*d* and provide a vacuum sealed coupling between second port 16 and adapter 30. As shown in FIG. 2, flange fittings can be used to provide a vacuum or pressure rated sealed coupling between respective flanges or coupling points, and provide greater structural rigidity and reliability than slip nut fitting. Flange fittings 20*c* and 20*d* can comprise suitable vacuum or pressure rated flange fitting for example but not limited to KF flanges, CF flanges, threaded flanges, or mechanically secured flanges such as bolted flanges. Also, use of a substantially planar adapter 30, and relocation of outlet 32 to second port 16, allows apparatus 10 to be reduced to a smaller form-factor while having the same overall functionality and performance to that shown in FIG. 1. Flange fitting 20*d* can also facilitate a more modular design for removing plug displacement tool 40 and installing a servicing tool module for use to service tank 50, and then removing the servicing tool and replacing plug displacement tool 40 to reinstall plug 24.

Figure 3:
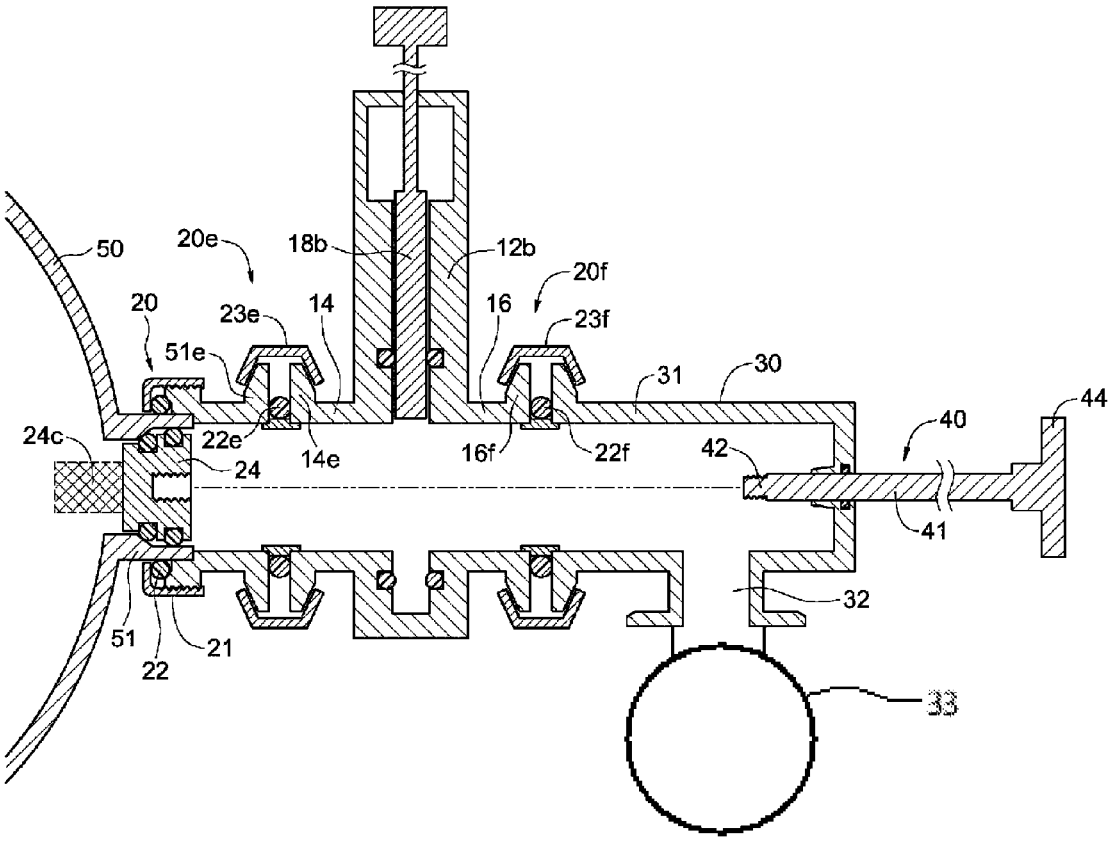
FIG. 3 is a cross-sectional side view of an apparatus for servicing a plug or a tank, according to another embodiment.

FIG. 3 illustrates another example of apparatus 10, having features similar to that shown in FIGS. 1 and 2. However, the embodiment in FIG. 3 differs in that valve 12*b* comprises a gate valve with valve member 18*b* comprising a movable gate. Tank flange 51*e* is removable and sealingly coupled to tank port 51 via slip nut fitting 20 illustrating that apparatus 10 can comprise adapter couplings for attachment to tanks with different coupling means. If tank 50 had a flanged coupling, then flange 14*e* could be coupled directly to tank 50. Plug 24 further comprises getter material 24*c* mounted on its side that sits inside tank 50 when installed. Getter material 24*c* comprises a deposit of reactive material that combines or absorbs molecules striking the getter material 24*c* to help achieve and maintain a vacuum environment. Accordingly, when plug 24 seals a vacuum insulation space use of getter material 24*c* on plug 24 can remove small amounts of gas from the insulation space of tank 50. Plug 24 in the embodiments of FIGS. 1 and 2 can also comprise getter material 24*c*. Getter material 24*c* can be removed from tank 50 by way of apparatus 10 for inspection and/or replacement or getter material 24*c* can be added by way of apparatus 10 to tank 50.

While particular examples of apparatus 10 are shown above, it is understood that many variations are possible, and included in other embodiments. For example, valves 12 and 12*b* can comprise one of a number of suitable vacuum-rated, or positive pressure rated, valves including a ball valve, a gate valve, a butterfly valve, or other suitable types of valves having a similar function to that described above. Attachment mechanism 42 can comprise one of a number of mechanisms used to sufficiently couple displacement tool 40 to plug 24, including a ball and socket connection, a snap fit connection, a hook and loop connection, an adhesive connection, magnetic, clip, clamp, or other types of mechanical connections capable of performing the same function. Plug displacement tool 40 can comprise a telescopic rod, a flexible arm, a lever, a torque multiplier extraction tool, an electrically assisted extraction tool, or a pneumatic or hydraulic device sufficient to displace the plug 24. Adapter 30 can also comprise a tee fitting. Fittings 20, 20*b*, 20*c*, 20*d*, 20*e*, 20/can also comprise one of a pipe clamp, a bayonet clamp, a threaded coupling, a bolted flange connection, or other type of device sufficient to provide a sealed vacuum or pressure rating coupling. Seal 43 can comprise a bellows for sealingly coupling adapter 30 to plug displacement tool 40. Plug 24 can comprise threading for screwing into tank port 51 or can be mechanically attached to tank port 51 in order to fasten plug 24 when tank 50 maintains a positive pressure. Finally, the step of removing air or adding pressurized fluid to the interior cavity or secondary cavity (via outlet 32) can be performed through suitable devices, such as a high pressure vacuum pump, compressor, or injector, referred to with reference numeral 33, that can remove air or add fluid to maintain a sufficient pressure level. All of these variations are included in alternative embodiments not shown above.

Figure 4:
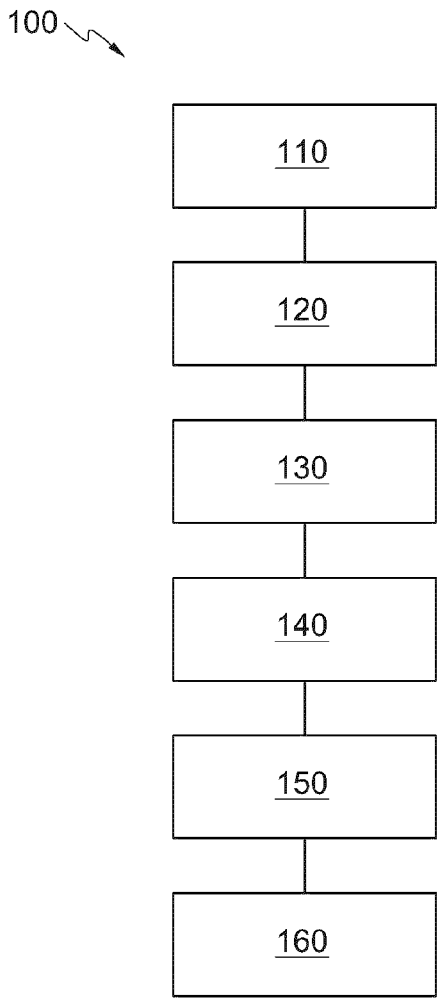
FIG. 4 is a flow chart illustrating a method for removing a plug on a tank for servicing.

FIG. 4 shows a flow chart that describes method 100 for removing plug 24 for servicing while maintaining a pressure in tank 50. Method 100 is described in relation to FIGS. 1 and 2 and a similar method is understood with reference to FIG. 3. At step 110, first port 14 of valve 12 is sealingly coupled to tank port 51 surrounding plug 24. At step 120, adapter 30 is sealingly coupled to second port 16 of valve 12, thereby defining an interior cavity between plug 24, valve 12, and adapter 30 when valve member 18 is in an opened position. At step 130, the interior cavity is pressurized to maintain a standing pressure in the interior cavity. At step 140 plug 24 is displaced from tank 50 beyond the valve member 18 of valve 12. At step 150 valve member 18 is actuated to a closed position to provide a sealed barrier between first port 14 and second port 16. At step 160, adapter 30 is decoupled from second port 16 to expose displaced plug 24 for servicing or replacement.

As described above, the pressure in tank 50 can be a positive or negative pressure. Accordingly, for negative pressure applications, the step of pressurizing the interior cavity comprises removing air from the interior cavity, and the standing pressure comprises a vacuum pressure equal or less than the original pressure in tank 50. For positive pressure applications, the step of pressurizing the interior cavity comprises injecting pressurized fluid into the interior cavity, and the standing pressure comprises a positive pressure equal to or greater than the original pressure in tank 50. Furthermore, the step of displacing plug 140 can be performed through plug displacement tool 40. Plug displacement tool 40 can comprise elongated rod 41 with a male or female threading as attachment means 42 for coupling onto a corresponding threading on plug 24. Adapter 30 can comprise outlet 32 by which interior cavity can be pressurized by connection to a pump, compressor, or a suitable vacuum device, referred to with reference numeral 33 in FIGS. 1, 2 and 3, to pressurize the interior cavity to the standing pressure.

Figure 5:
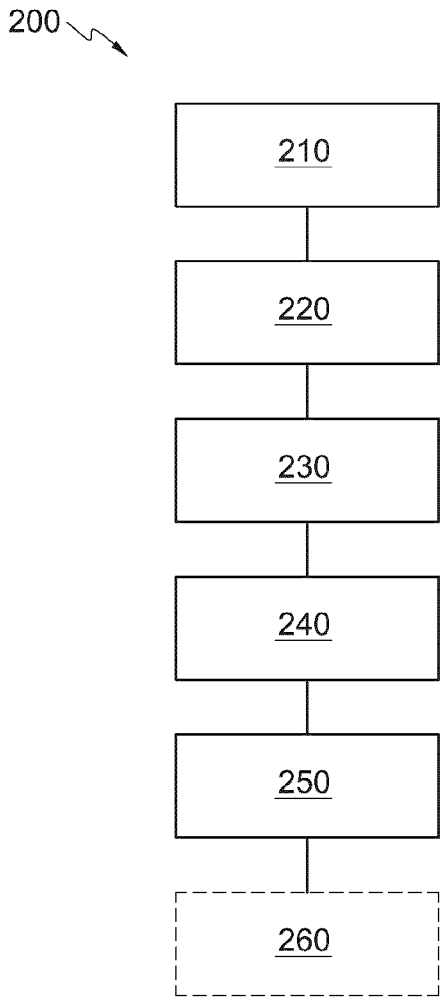
FIG. 5 is a flow chart illustrating a method for installing a serviced plug onto a tank.

Referring to FIG. 5, a flow chart is provided that describes method 200 for installing plug 24, which can be performed after removing plug 24 via method 100 in FIG. 4 and servicing plug 24. Method 200 is described in relation to FIGS. 1 and 2 and a similar method is understood with reference to FIG. 3. At step 210, plug 24 is aligned between the valve member 18 and adapter 30. At step 220 the adapter 30 is sealingly coupled to second port 16 of valve 12 to thereby define a secondary cavity between adapter 30 and valve member 18 in closed position which encloses aligned plug 24. At step 230, the cavity is pressurized to sufficiently maintain a secondary pressure substantially the same as the pressure in tank 50 or the opposite side of valve 12. At step 240, valve member 18 is actuated to an open position to provide a pathway between first port 14 and second port 16. At step 250, plug 24 is installed into tank port 51. Apparatus 10 can be optionally removed from tank 50 at step 260 by decoupling first port 14 from tank port 51, or decoupling adapter 30 from second port 16.

Similar to that described for removing plug 24, method 200 for installing plug 24 can apply to tank 50 having either positive or negative pressures. For negative pressure applications, the step of pressurizing the secondary cavity comprises removing air from the secondary cavity, and the secondary pressure comprises a pressure equal or less than the pressure in tank 50. For positive pressure applications, the step of pressurizing the secondary cavity comprises injecting pressurized fluid into the secondary cavity, and the secondary pressure comprises a positive pressure equal to or greater than the pressure in tank 50. In certain embodiments, at step 210, plug 24 can be aligned by screwing plug 24 onto elongated rod 41 coupled to adapter 30. At step 250, plug 24 can be installed onto tank 50 by sliding elongated rod 41 to position plug 24 into tank port 51. Method 200 can further comprise decoupling plug 24 from displacement tool 40 prior to decoupling apparatus 10 from tank 50 in optional step 260.

The disclosed method and apparatus 10 allows tank 50 and plug 24 to be serviced by conveniently removing plug 24 from tank 50 without exposing contents held within tank 50 to external contaminants or atmospheric pressures. Accordingly, the tank pressure level can be maintained during servicing, which can extend the life of the tank, and can reduce repair and servicing costs. The method and apparatus 10 can also reduce the need for inert gases, such as Nitrogen, that can otherwise be required for introduction into tank 50 when plug 24 is directly removed in atmosphere. After servicing tank 50 or plug 24, apparatus 10 can be used to install plug 24 into tank 50 without compromising the tank pressure level or exposing the tank contents to external contaminants or atmospheric pressure.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. An apparatus comprising:

(a) a body comprising:
  (i) a first port configured to connect onto a tank port;
  (ii) a second port opposite to said first port;
  (iii) an interior cavity between said first and second ports; and
  (iii) an outlet in fluid communication with said interior cavity for removing or supplying air or a pressurized fluid;

(b) a valve proximal to said first port, wherein said valve comprises:
  (i) a valve member configured to transform between an open position that provides a pathway between said first port and said second port wherein said pathway is large enough to allow passage of a plug, and a closed position that provides a sealed barrier between said first port and said second port;

(c) a plug displacement tool, wherein said plug displacement tool comprises:
  (i) a member that is extendable through said valve in said open position to engage with said plug; and (d) one of a pump, a compressor and a vacuum device selectively and operatively connected with said outlet for establishing a standing pressure in said interior cavity;

wherein said standing pressure is a negative pressure equal to or below atmospheric pressure.

2. The apparatus of claim 1 wherein said second port comprises a sealable opening that can be opened to access an attachment mechanism of said plug displacement tool to access said plug.

3. The apparatus of claim 1 wherein said body is separable into a first part and a second part; said first part comprising a coupling for attachment to said tank port and a housing for said valve; and said second part comprising an adapter in the form of a housing for said plug displacement tool.

4. The apparatus of claim 3 wherein said plug displacement tool comprises an attachment mechanism at a contact end for engagably coupling said plug to said contact end.

5. The apparatus of claim 3 wherein said plug displacement tool is a substantially elongated rod for engagably coupling with said plug when said apparatus is coupled to said tank port; and said elongated rod is slidingly coupled to said adapter and is slidable for engagably coupling with said plug, and for displacing plug when engagably coupled.

6. The apparatus of claim 3 wherein said adapter comprises said outlet.

7. The apparatus of claim 3 further comprising:

(e) fittings for sealingly coupling said adapter to said second port, and said tank port to said first port.

8. A method for removing a plug from a sealing tank while preserving a pressure within said tank, said steps comprising:

(a) sealingly coupling a first port of a valve onto a tank port surrounding said plug;

(b) coupling an adapter to a second port of said valve to form a seal between said adapter and said second port, said adapter, valve, and said plug defining an interior cavity;

(c) pressurizing said interior cavity to sufficiently maintain a standing pressure within said interior cavity, wherein said standing pressure is one of a positive pressure greater than atmospheric pressure and a negative pressure equal to or less than atmospheric pressure;

(d) displacing said plug from said tank beyond a valve member of said valve;

(e) actuating said valve member of said valve to a closed position to provide a sealed barrier between said first and second ports; and (f) decoupling said adapter from said second port to remove said plug.

9. The method of claim 8 wherein a getter material is connected with said plug and said plug is removed from said tank such that said getter material can be inspected or replaced.

10. The method of claim 8 wherein said pressure within said tank is a vacuum, and said step of pressurizing said interior cavity comprises removing air from said interior cavity sufficient to maintain a standing vacuum within said interior cavity.

11. The method of claim 8 wherein: said step of displacing said plug from said tank is performed with a plug displacement tool.

12. The method of claim 8 further comprising (g) installing said plug wherein installing said plug comprises:

(i) introducing said plug into said adapter, and aligning the plug between the valve member and the adapter;

(ii) sealingly coupling said adapter to said second port of said valve to define a secondary cavity between said adapter and said valve member that encloses said plug;

(iii) pressurizing said secondary cavity to sufficiently maintain a secondary pressure within said secondary cavity;

(iv) actuating said valve member of said valve to an open position to provide a pathway between said first and second ports; and (v) installing said plug into said tank port.

13. The method of claim 12 wherein said pressure within said tank is a vacuum, and said secondary pressure comprises a pressure equal to or lower than said vacuum within said tank.

14. The method of claim 12 further comprising (h) decoupling said plug from said plug displacement tool prior to said step of decoupling said first port from said tank.

15. The method of claim 12 further comprising (h) servicing said plug.

16. The method of claim 12; further comprising:

(h) introducing a servicing tool into said adapter;

(i) sealing coupling said adapter to said second port of said valve assembly to define a secondary cavity between said valve member in closed position, said second port, and adapter; and (j) pressurizing said secondary cavity and opening said valve member to provide access for said servicing tool to service said tank.

17. The method of claim 16 further comprising:

(k) servicing said tank with said servicing tool wherein said servicing tool is selected from said list consisting of: a cleaning tool, a stereoscope, a camera, a radiation emitting device, and a sampling device.

18. The method of claim 16 further comprising (k) installing said plug wherein installing said plug comprises:

(i) actuating said valve member of said valve to a closed position, and removing said servicing tool from said adapter;

(ii) introducing said plug into said adapter, and aligning said plug between said valve member and said adapter;

(iii) pressurizing said secondary cavity to sufficiently maintain a secondary pressure within said secondary cavity;

(iv) actuating said valve member of said valve to an open position to provide a pathway between said first and second ports; and (v) installing said plug into said tank port.

19. A method of removing a plug installed in a port of a vessel, said plug employed to preserve a pressure of an interior space on one side of said plug comprising:

(a) creating an enclosing space on a second side of said plug opposite said one side of said plug, such that a pressure of said enclosing space equals said pressure of said interior space within a predetermined range;

(b) removing said plug from said port away from said interior space whereby said pressure of said interior space remains within said predetermined range;

(c) isolating a portion of said enclosing space containing said plug from said interior space; and (d) exposing said plug to atmosphere; wherein said pressure of said interior space remains within said predetermined range.

* * * * *